US010919296B2

(12) United States Patent
Kura

(10) Patent No.: US 10,919,296 B2
(45) **Date of Patent: *Feb. 16, 2021**

(54) LIQUID DISCHARGE HEAD HAVING A COMMON ELECTRODE OVERLAPPING INDIVIDUAL ELECTRODES

(71) Applicant: BROTHER KOGYO KABUSHIKI KAISHA, Nagoya (JP)

(72) Inventor: Keiji Kura, Chita (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/984,205

(22) Filed: Aug. 4, 2020

(65) Prior Publication Data

US 2020/0361208 A1 Nov. 19, 2020

Related U.S. Application Data

(63) Continuation of application No. 16/535,648, filed on Aug. 8, 2019, now Pat. No. 10,780,694.

(30) Foreign Application Priority Data

Aug. 30, 2018 (JP) ..... 2018-161765

(51) Int. Cl.
*B41J 2/14* (2006.01)
*B41J 2/16* (2006.01)
*B41J 2/055* (2006.01)

(52) U.S. Cl.
CPC ..... *B41J 2/14233* (2013.01); *B41J 2/055* (2013.01); *B41J 2/161* (2013.01);
(Continued)

(58) Field of Classification Search
CPC ..... B41J 2/14233; B41J 2/161; B41J 2/055; B41J 2002/14491; B41J 2002/14241; B41J 2002/14266; B41J 2002/14258
See application file for complete search history.

(56) References Cited

U.S. PATENT DOCUMENTS 7,014,300 B2 3/2006 Hirota et al.
7,571,993 B2 8/2009 Ito
(Continued)

FOREIGN PATENT DOCUMENTS

JP 2003-311956 A 11/2003
JP 2006-142571 A 6/2006
JP 2008-006685 A 1/2008

OTHER PUBLICATIONS

Notice of Allowance dated May 20, 2020 from related U.S. Appl. No. 16/535,648.

*Primary Examiner* — Henok D Legesse
(74) *Attorney, Agent, or Firm* — Scully, Scott, Murphy & Presser, PC

(57) ABSTRACT

There is provided a liquid discharge head, including: a piezoelectric body having a plurality of piezoelectric layers stacked on top of each other in a stacking direction; individual electrodes; and a first common electrode. Each of the individual electrodes has a first portion and a second portion arranged in the first direction at an interval, and a third portion coupling the first portion with the second portion. The first common electrode includes a first extending portion as well as first protrusions and second protrusions protruding from the first extending portion. Portions of the first extending portion overlapping in the stacking direction with the third portions are formed having through holes passing through the first common electrode in the stacking direction.

20 Claims, 11 Drawing Sheets

(52) U.S. Cl.
CPC ..... *B41J 2002/14241* (2013.01); *B41J 2002/14258* (2013.01); *B41J 2002/14266* (2013.01); *B41J 2002/14491* (2013.01)

(56) References Cited

U.S. PATENT DOCUMENTS

| | | | | |
|---|---|---|---|---|
| 7,780,274 | B2 | 8/2010 | Takahashi | |
| 8,616,683 | B2 | 12/2013 | Hara | |
| 8,973,228 | B2 | 3/2015 | Sugahara | |
| 2003/0156166 | A1 | 8/2003 | Sakaida | |
| 2006/0103698 | A1 | 5/2006 | Takahashi | |
| 2020/0070192 | A1* | 3/2020 | Kura | B41J 2/055 |

* cited by examiner

LIQUID DISCHARGE HEAD HAVING A COMMON ELECTRODE OVERLAPPING INDIVIDUAL ELECTRODES

CROSS REFERENCE TO RELATED APPLICATION

The present application is a continuation application of U.S. Ser. No. 16/535,648 filed on Aug. 8, 2019 and claims priority from Japanese Patent Application No. 2018-161765 filed on Aug. 30, 2018, the disclosure of which is incorporated herein by reference in its entirety.

BACKGROUND

Field of the Invention

The present disclosure relates to a liquid discharge head configured to discharge a liquid, such as ink, on a medium.

Description of the Related Art

There is known, as a liquid discharge apparatus, an ink-jet head of an ink-jet printer that forms an image by discharging ink on a recording medium while moving relative to the recording medium. For example, there is publicly known, as an ink-jet head included in a publicly known ink-jet printer, an ink-jet head that has a piezoelectric body in which piezoelectric material layers (ceramic sheet) are stacked.

SUMMARY

The ink-jet head includes an actuator unit including the piezoelectric body in which the piezoelectric material layers are stacked and a channel unit including pressure chambers. A piezoelectric material layer included in the piezoelectric material layers has, on its surface, individual electrodes and another piezoelectric material layer included in the piezoelectric material layers has, on its surface, a common electrode. The individual electrodes are provided corresponding to the pressure chambers. The ink-jet head is controlled so that predefined voltage is simultaneously applied to two individual electrodes corresponding to two adjacent pressure chambers. Controlling the ink-jet head to discharge ink from the two adjacent pressure chambers to a nozzle enables a sufficient amount of ink discharge.

In a manufacturing process of the ink-jet head, the actuator unit may be joined to the channel unit with foreign matter, such as dust, interposed therebetween. This may cause a small crack in the piezoelectric body of the actuator unit. For example, in an area above a wall partitioning the two pressure chambers, pressure applied to the piezoelectric body when the actuator unit is joined to the channel unit can not escape, which easily cracks the piezoelectric body. Here, in order to discharge ink from two adjacent pressure chambers to one nozzle simultaneously, two individual electrodes corresponding to the two adjacent pressure chambers may be coupled to each other so that they function as one individual electrode. In that case, the coupling portion coupling the two individual electrodes to each other is positioned above the wall partitioning the two pressure chambers, which easily cracks the piezoelectric body as described above. When voltage is applied to the individual electrode with the piezoelectric body having the crack, a short circuit may occur between the coupling portion and the common electrode.

An object of the present disclosure is to provide a liquid discharge head in which, when one individual electrode is provided corresponding to two or more of pressure chambers, electrical reliability between a common electrode and a portion of the individual electrode positioned between the pressure chambers is achieved.

According to an aspect of the present disclosure, there is provided a liquid discharge head, including: a piezoelectric body including a plurality of piezoelectric layers stacked stacked in a stacking direction, the piezoelectric body having a first end and a second end which are away from each other in a first direction orthogonal to the stacking direction of the piezoelectric layers, a plurality of individual electrodes located on a first surface that is orthogonal to the stacking direction, and a first common electrode located on a second surface that is orthogonal to the stacking direction, the first common electrode being different in a position in the stacking direction from the first surface. Each of the individual electrodes includes a first portion and a second portion arranged in the first direction at an interval, and a third portion connecting the first portion and the second portion, the first portion being positioned between the first end and the third portion in the first direction, the third portion being positioned between the first portion and the second portion in the first direction, the second portion being positioned between the third portion and the second end in the first direction. The first portions, the second portions, and the third portions of the individual electrodes are arranged between the first end and the second end to form rows along a second direction orthogonal to the stacking direction and intersecting with the first direction, thus forming a first portion row, a second portion row, and a third portion row. The first common electrode includes: a first extending portion extending in the second direction to pass through a position between the first portion row and the second portion row in the first direction; a plurality of first protrusions protruding from the first extending portion toward the first end; and a plurality of second protrusions protruding from the first extending portion toward the second end. Each of the first protrusions partially overlaps in the stacking direction with one of the first portions of the individual electrodes forming the first portion row. Each of the second protrusions partially overlaps in the stacking direction with one of the second portions of the individual electrodes forming the second portion row. Portions of the first extending portion overlapping in the stacking direction with the third portions are formed having through holes passing through the first common electrode in the stacking direction.

In the above configuration, the portions of the first common electrode overlapping in the stacking direction with the third portions of the individual electrodes are formed having the through holes. The third portions of the individual electrodes thus do not overlap in the stacking direction with the first common electrode. In that configuration, when predefined voltage is applied to the individual electrodes, an electrical field in the stacking direction is not likely to occur between the third portions of the individual electrodes and the first common electrode. A short circuit between the third portions of the individual electrodes and the first common electrode in the piezoelectric body can thus be inhibited.

DESCRIPTION OF THE EMBODIMENTS

<Schematic Configuration of Printer>

Figure 1:
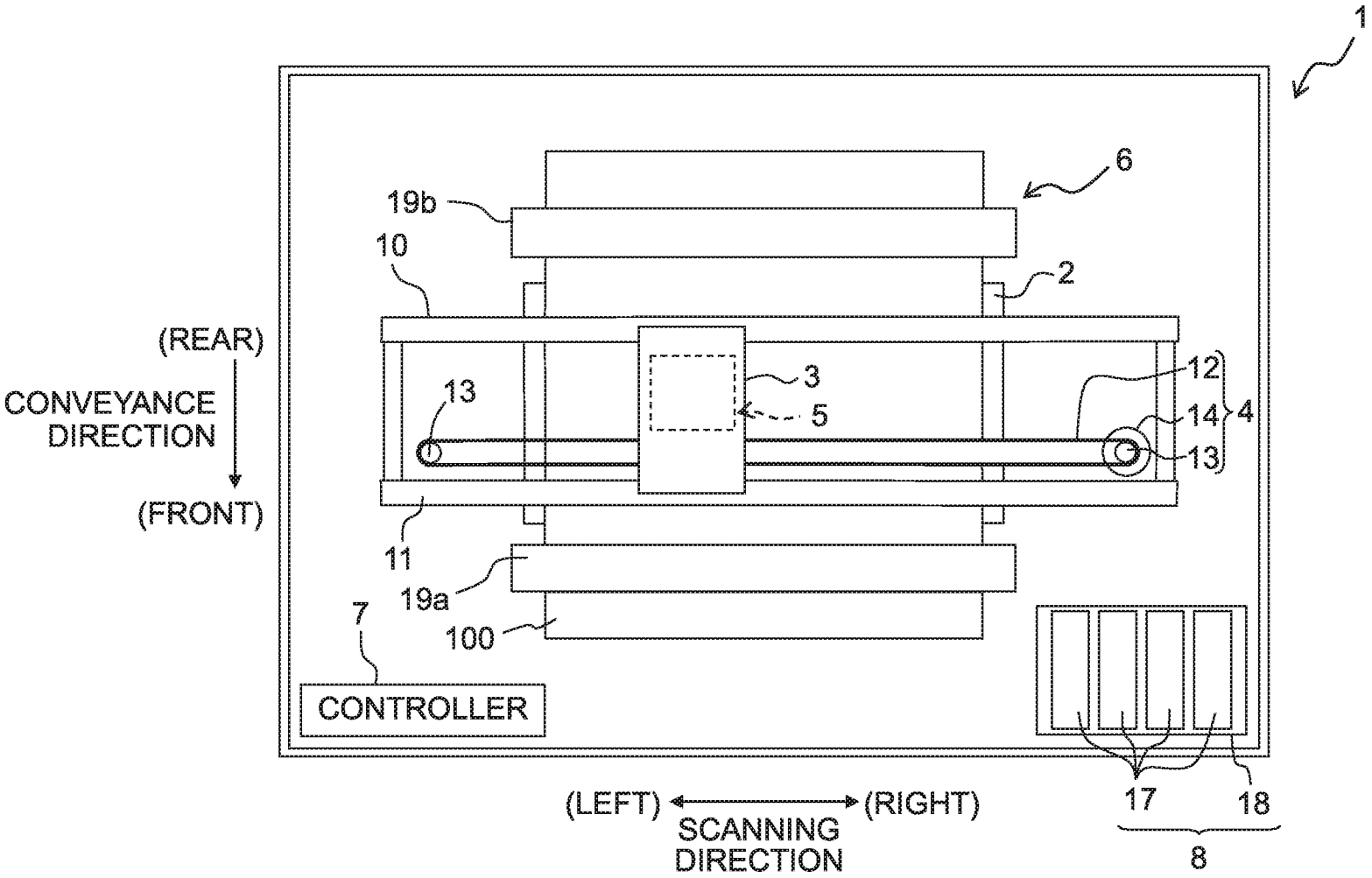
FIG. 1 is a plan view schematically depicting an ink-jet printer 1 according to an embodiment.

An embodiment of the present disclosure is explained. As depicted in FIG. 1, an ink-jet printer 1 mainly includes a platen 2, a carriage 3, a carriage driving mechanism 4, an ink-jet head 5, a conveyance mechanism 6, a controller 7, and an ink supply unit 8. In the following, a left-right direction (scanning direction) and a front-rear direction (conveyance direction) of the ink-jet printer 1 are defined as indicated in FIG. 1.

A recording sheet 100, which is a recording medium, is placed on an upper surface of the platen 2. The carriage 3 driven by the carriage driving mechanism 4 reciprocates in the left-right direction (hereinafter referred to as the scanning direction) in an area facing the platen 2 along two guide rails 10 and 11. The carriage driving mechanism 4 includes a belt 12, two rollers 13 disposed at both sides in the scanning direction of the platen 2 with the platen 2 interposed therebetween, and a carriage driving motor 14. The carriage 3 is coupled to the belt 12. The belt 12 is wound around the two rollers 13 disposed away from each other in the scanning direction to form an elliptical ring that is long in the scanning direction when seen from above. As depicted in FIG. 1, the right roller 13 is coupled to a rotation shaft of the carriage driving motor 14. Rotating the carriage driving motor 14 allows the belt 12 to run around the two rollers 13. This allows the carriage 3 coupled to the belt 12 to reciprocate in the scanning direction.

The ink-jet head 5, which is carried on the carriage 3, reciprocates in the scanning direction together with the carriage 3. An ink supply unit 8 includes four ink cartridges 17, a cartridge holder 18 in which the four ink cartridges 17 are installed, and tubes (not depicted). The four ink cartridges 17 contain inks of four colors (black, yellow, cyan, and magenta), respectively. The ink-jet head 5 is connected to the four ink cartridges 17 via the tubes (not depicted). This allows the inks of four colors to be supplied from the ink supply unit 8 to the ink-jet head 5.

Figure 3:
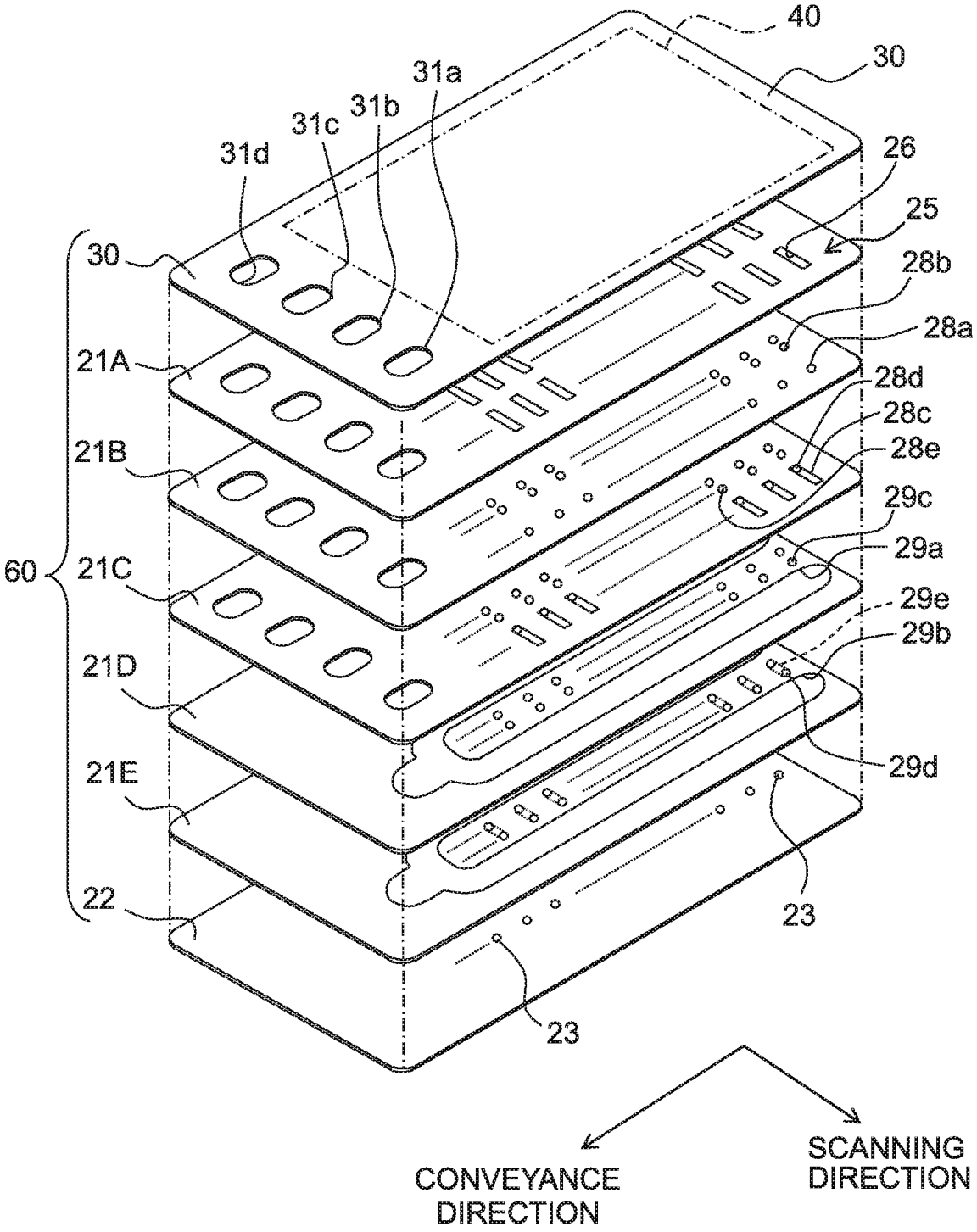
FIG. 3 is a schematic exploded view of a stacked body according to the embodiment.

A lower surface of the ink-jet head 5 (the far side of the sheet surface of FIG. 1) has nozzles 23 (see FIG. 3). Each of the inks supplied from the corresponding one of the ink cartridges 17 is discharged from each nozzle 23 onto the recording sheet 100 placed on the platen 2.

The conveyance mechanism 6 has two conveyance rollers 19*a* and 19*b* that are disposed to interpose the platen 2 therebetween in the front-rear direction. The conveyance mechanism 6 conveys the recording sheet 100 placed on the platen 2 frontward (hereinafter also referred to as the conveyance direction) by use of the two conveyance rollers 19*a* and 19*b*.

The controller 7 includes a Read Only Memory (ROM), a Random Access Memory (RAM), and an Application Specific Integrated Circuit (ASIC) including a control circuit, and the like. The controller 7 controls the ASIC to execute a variety of processing, such as printing on the recording sheet 100, in accordance with programs stored in the ROM. For example, in print processing, the controller 7 controls the ink-jet head 5, the carriage driving motor 14, and the like to execute printing of an image on the recording sheet 100 based on a printing command input from an external apparatus, such as a PC. Specifically, the controller 7 alternately executes an ink discharge operation and a conveyance operation. In the ink discharge operation, ink is discharged during movement in the scanning direction of the ink-jet head 5 and the carriage 3. In the conveyance direction, the recording sheet 100 is conveyed in the conveyance direction by a predefined amount by use of the conveyance rollers 18 and 19.

Figure 2:
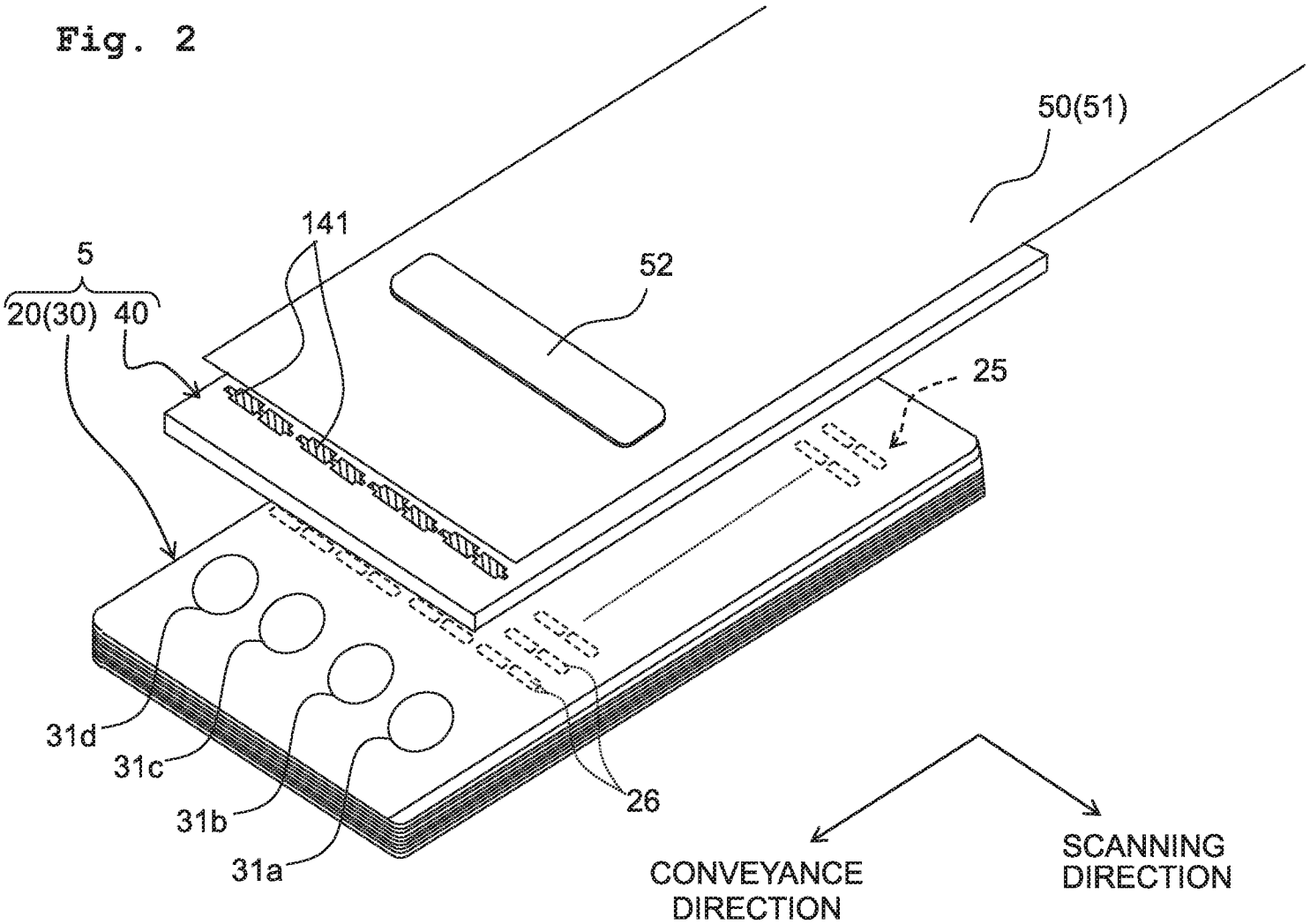
FIG. 2 schematically depicts an ink-jet head 5 and a trace member 50 according to the embodiment.

The ink-jet head 5 mainly includes a channel unit 20, a vibration plate 30, a piezoelectric body 40, and a trace member 50 (see FIG. 2). As depicted in FIG. 3, the channel unit 20 includes a nozzle plate 22 and five metal plates 21A to 21E. The vibration plate 30 is joined to an upper surface of the metal plate 21A of the channel unit 20. In the following explanation, a combination or group of the channel unit 20 and the vibration plate 30 is referred to as a stacked body 60. Namely, as depicted in FIG. 3, the stacked body 60 is formed by stacking the vibration plate 30, the five metal plates 21A to 21E, and the nozzle plate 22 in that order from the top, and joining them to each other. The direction in which those plates of the stacked body 60 are stacked on top of each other is referred to as a stacking direction.

The vibration plate 30 is a substantially rectangular metal plate that is long in the conveyance direction. Similarly, the metal plates 21A to 21E and the nozzle plate 22 are substantially rectangular plates when seen from above. As depicted in FIGS. 2 and 3, an end in the conveyance direction of the vibration plate 30 has four openings 31*a* to 31*d* functioning as ink supply ports through which inks are supplied to manifolds described below. The four openings 31*a* to 31*d* are arranged in the scanning direction (left-right direction). The opening 31*a* is the ink supply port for yellow ink, the opening 31*b* is the ink supply port for magenta ink, the opening 31*c* is the ink supply port for cyan ink, and the opening 31*d* is the ink supply port for black ink. In this embodiment, the four openings 31*a* to 31*d* have the same area or dimension.

The plate 21A is a metal plate in which openings functioning as pressure chambers 26 are formed regularly. The plate 21A has openings at positions overlapping with the four openings 31*a* to 31*d* of the vibration plate 30. The pressure chambers 26 form a pressure chamber row 25 in which the pressure chambers 26 are arranged in the conveyance direction at an arrangement pitch (arrangement interval) P. Although only some of pressure chamber rows 25 are depicted in FIG. 3, the plate 21A includes eight pressure chamber rows 25 arranged in the scanning direction (left-right direction) as described below (see FIG. 2).

Six of the eight pressure chamber rows 25 are pressure chamber rows 25 for color inks, and the remaining two pressure chamber rows 25 are pressure chamber rows 25 for black ink. As depicted in FIG. 2, the two pressure chamber rows 25 for black ink are arranged adjacent to the opening 31*d* in the conveyance direction. The six pressure chamber rows 25 for color inks include two pressure chamber rows 25 for cyan ink, two pressure chamber rows 25 for magenta ink, and two pressure chamber rows 25 for yellow ink. The two pressure chamber rows 25 for cyan ink are arranged adjacent to the opening 31*c* in the conveyance direction. The two pressure chamber rows 25 for magenta ink are arranged adjacent to the opening 31*b* in the conveyance direction. The two pressure chamber rows 25 for yellow ink are arranged adjacent to the opening 31*a* in the conveyance direction.

The position in the conveyance direction of each pressure chamber 26 in one of the two pressure chamber rows 25 for black ink is the same as that in the other. The same is true of the two pressure chamber rows 25 for cyan ink, the two pressure chamber rows 25 for magenta ink, and the two pressure chamber rows 25 for yellow ink. Two pressure chambers 26 that are included in the pressure chambers 26 forming the two pressure chamber rows 25 for each of the inks and are arranged at the same position in the conveyance direction may be referred to as a pressure chamber 26 pair.

Figure 4A:
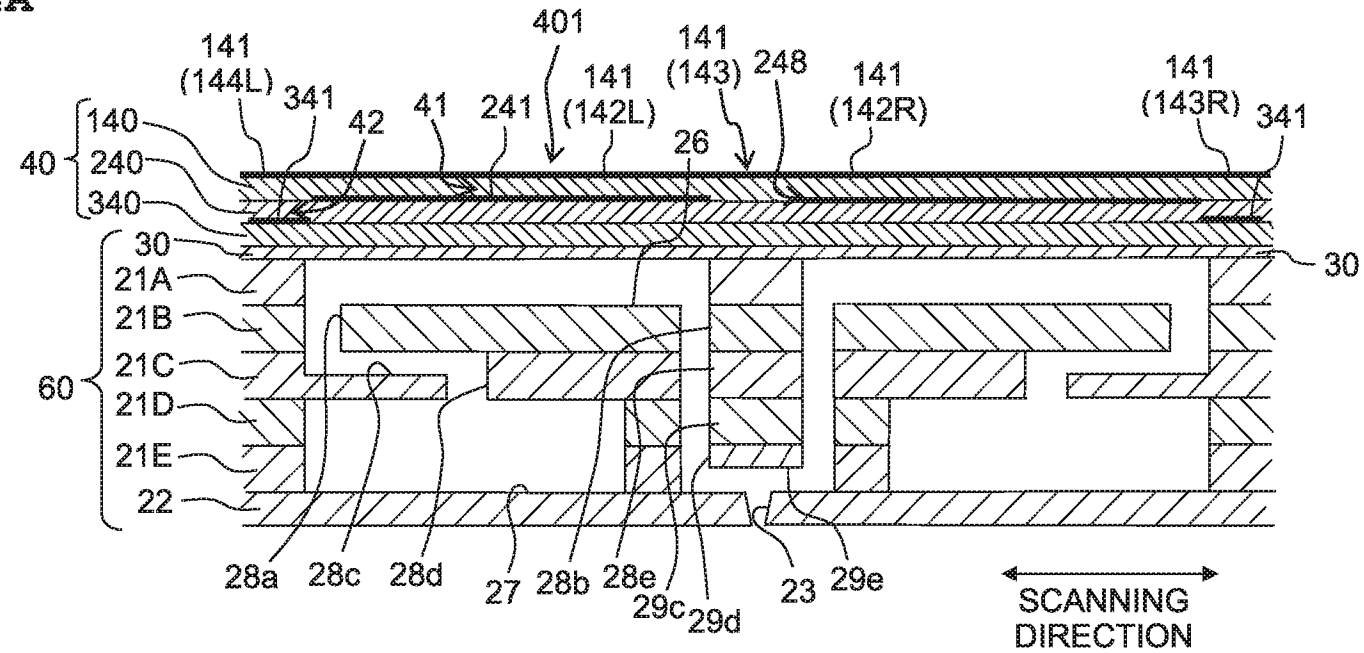
FIG. 4A is a schematic cross-sectional view of the ink-jet head in a scanning direction according to the embodiment, and FIG. 4B a schematic cross-sectional view of the ink-jet head in a conveyance direction according to the embodiment.

As depicted in FIGS. 3 and 4A, the plate 21B has communicating holes 28*a* each of which forms a channel ranging from a manifold 27 (common ink chamber) described below to each pressure chamber 26 and communicating holes 28*b* each of which forms a channel ranging from each pressure chamber 26 to each nozzle 23 described below. An upper surface of the plate 21C includes communicating channels 28*c* each of which causes the pressure chamber 26 to communicate with the manifold 27. The communicating channels 28*c* are formed as recesses. The plate 21C has communicating holes 28*d* each of which forms a channel ranging from the manifold 27 to the pressure chamber 26 and communicating holes 28*e* each of which forms a channel ranging from the pressure chamber 26 to the nozzle 23. The plates 21B and 21C have openings at the positions overlapping with the four openings 31*a* to 31*d* of the vibration plate 30. The plate 21D has a through hole 29*a* and the plate 21E has a through hole 29*b*. The through holes 29*a* and 29*b* form the manifold 27. The plate 21D has communicating holes 29*c* each of which forms a part of the channel ranging from the pressure chamber 26 to the nozzle 23, and the plate 21E has communicating holes 29*d* each of which communicates with one of the communicating hole 29*c* to form a part of the channel ranging from the pressure chamber 26 to the nozzle 23. A lower surface of the plate 21E is provided with communicating channels 29*e* each of which connects two communicating holes 29*d* and the nozzle 23. The communicating channels 29*e* are formed as recesses. The communicating channel 29*e* connects two communicating holes 29*d* that are arranged at the same position in the conveyance direction. The two communicating holes 29*d* communicate with the two pressure chambers 26 forming the pressure chamber 26 pair. Thus, two channels extending from the two pressure chambers 26, which form the pressure chamber 26 pair, toward the nozzle 23 join each other at one of the communicating channels 29*e* and communicate with one nozzle 23.

The nozzle plate 22 is a plate made using a synthetic resin (e.g., polyimide resin). Each nozzle 23 is formed corresponding to the pressure chambers 26 in the plate 21A. As described above, one nozzle 23 is formed corresponding to two pressure chambers 26 forming the pressure chamber 26 pair.

Figure 4B:
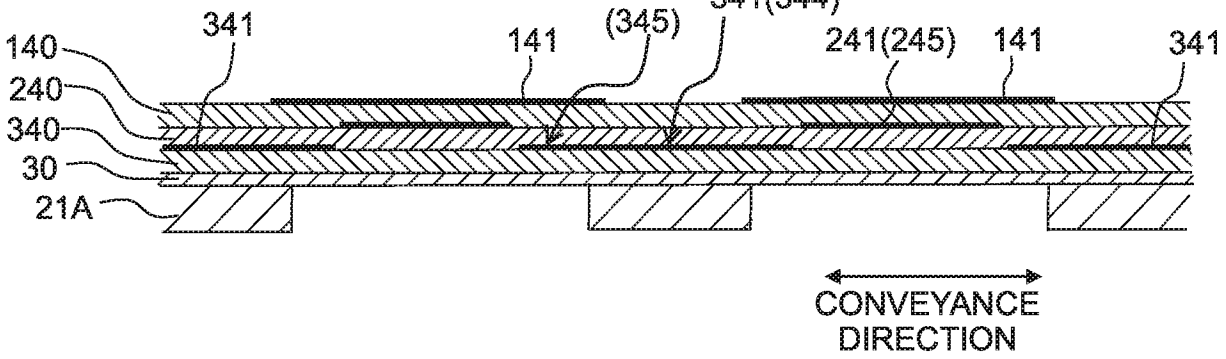

As depicted in FIGS. 4A and 4B, channels ranging from the manifold to the nozzles 23 via the pressure chambers 26 are formed by stacking the vibration plate 30, the plates 21A to 21E, and the nozzle plate 22 from the top and joining them. Ink supply channels for supplying inks to the manifold 27 are also formed.

The vibration plate 30 and the plates 21A to 21E are metal plates, and thus they can be joined with each other by metal diffusion joining. The nozzle plate 22 is a plate made using resin, and thus the nozzle plate 22 is joined to the plate 21E by adhesive instead of metal diffusion joining. The nozzle plate 22 may be a metal plate. In that case, the nozzle plate 22 can be joined to the plate 21E by metal diffusion joining similarly to the joining of the vibration plate 30 to the plates 21A to 21E. Or, all of the plates may be joined with each other by adhesive or the like.

<Piezoelectric Body 40>

For example, as depicted in FIGS. 2 and 3, the piezoelectric body 40 is disposed on the vibration plate 30. The piezoelectric body 40 has a substantially rectangular planar shape. As depicted in FIGS. 4A and 4B, the piezoelectric body 40 includes piezoelectric elements 401. Each piezoelectric element 401 is provided corresponding to two pressure chambers 26 that are arranged at the same position in the conveyance direction. Each piezoelectric element 401 cooperates with the vibration plate 30 to change the volume of the corresponding two pressure chambers 26 simultaneously. Accordingly, each piezoelectric element 401 cooperates with the vibration plate 30 to apply pressure to ink in the corresponding two pressure chambers 26 simultaneously, which consequently applies, to ink, energy for discharging ink from the nozzle 23 that communicates with the two pressure chambers 26.

The configuration of the piezoelectric body 40 is explained below. As depicted in FIGS. 4A and 4B, the piezoelectric body 40 includes three piezoelectric layers (upper piezoelectric layer 140, intermediate piezoelectric layer 240, and lower piezoelectric layer 340), individual electrodes (upper electrodes) 141, an intermediate common electrode (intermediate electrode) 241, and a lower common electrode (lower electrode) 341. The lower piezoelectric layer 340, the intermediate piezoelectric layer 240, and the upper piezoelectric layer 140 are stacked on top of each other in that order on the vibration plate 30. The three piezoelectric layers 140, 240, and 340 are made using a piezoelectric material composed primarily of lead zirconate titanate (PZT), which is a mixed crystal of lead titanate and lead zirconate. Or, the three piezoelectric layers 140, 240, and 340 may be made using a non-lead-based piezoelectric material containing no lead. The lower common electrode 341 is placed on an upper surface of the lower piezoelectric layer 340, the intermediate common electrode 241 is placed on an upper surface of the intermediate piezoelectric layer 240, and the individual electrodes 141 and the like are placed on an upper surface of the upper piezoelectric layer 140.

In the following, ends in the scanning direction of the upper piezoelectric layer 140 are referred to as ends 140L and 140R, and ends in the conveyance direction of the upper piezoelectric layer 140 are referred to as ends 140U and 140D (see FIG. 5). Ends in the scanning direction of the intermediate piezoelectric layer 240 are referred to as ends 240L and 240R and ends in the conveyance direction of the intermediate piezoelectric layer 240 are referred to as ends 240U and 240D (see FIG. 6). Ends in the scanning direction of the lower piezoelectric layer 340 are referred to as 340L and 340R and ends in the conveyance direction of the lower piezoelectric layer 340 are referred to as ends 340U and 340D (see FIG. 7).

Figure 5:
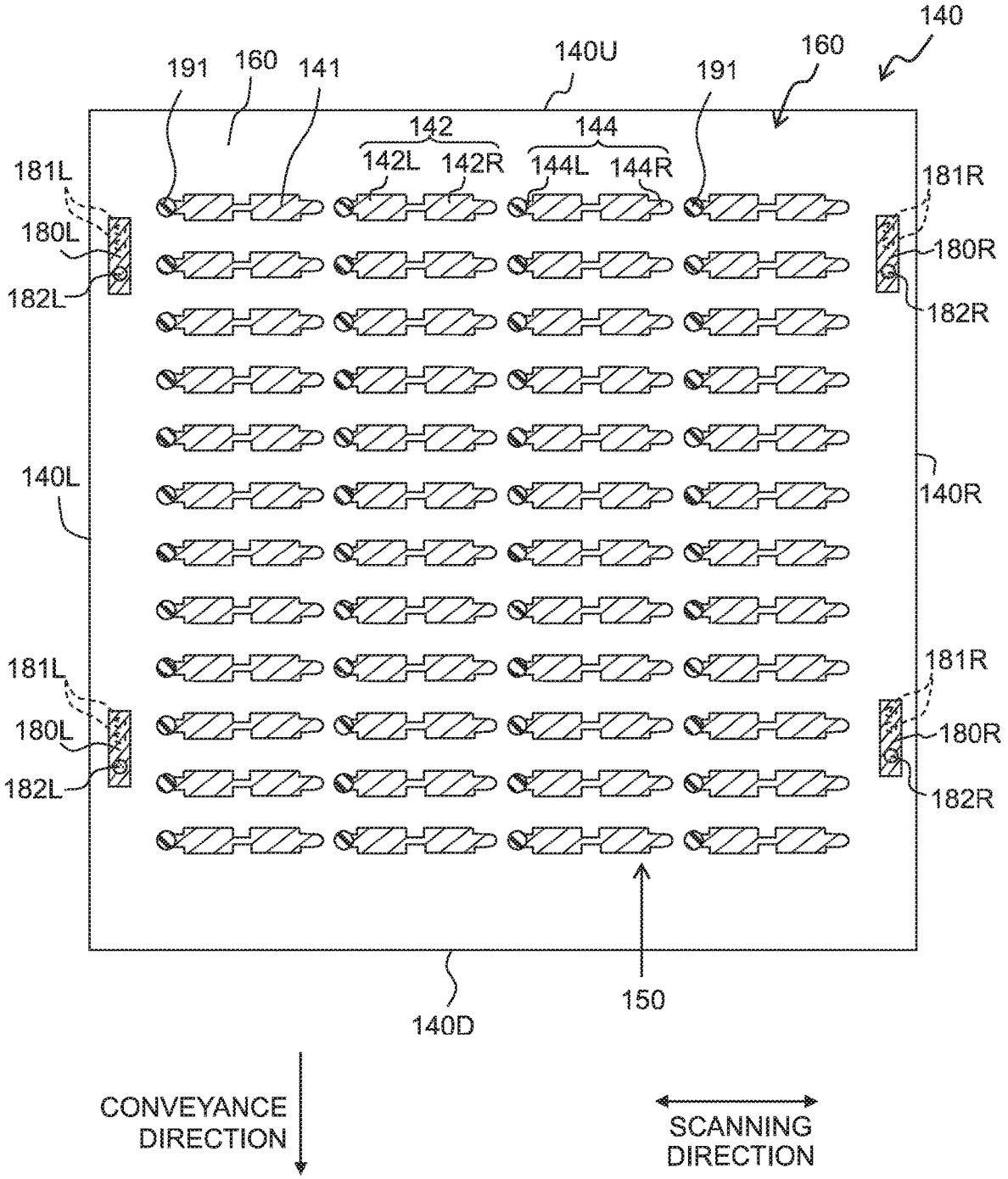
FIG. 5 is a top view of an upper piezoelectric layer 140 according to the embodiment.
Figure 6:
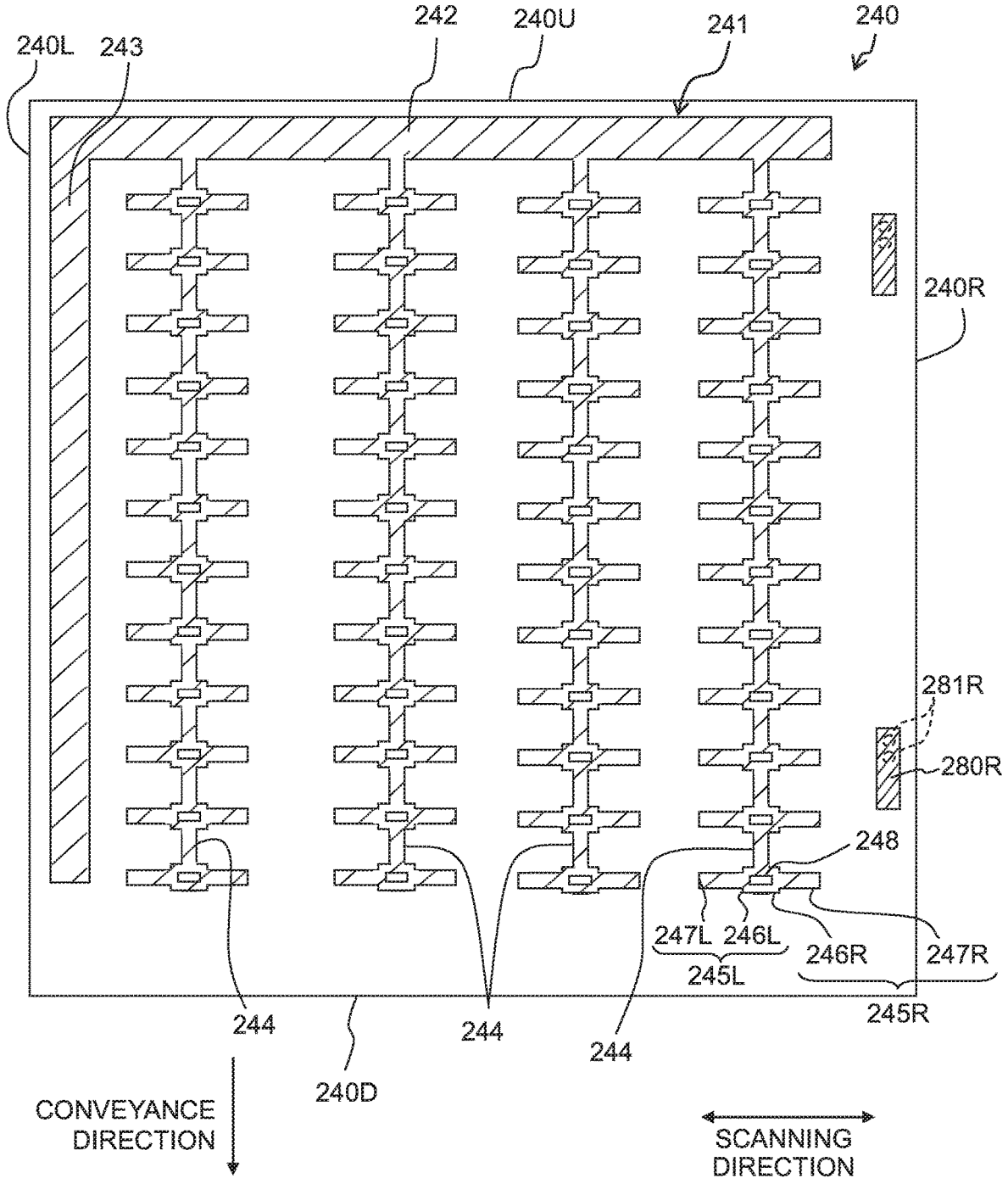
FIG. 6 is a top view of an intermediate piezoelectric layer 240 according to the embodiment.

As depicted in FIG. 5, two terminals 180R arranged in the conveyance direction are formed in the end 140R in the scanning direction of the upper piezoelectric layer 140. As depicted in FIG. 6, terminals 280R are formed in the end 240R in the scanning direction of the intermediate piezoelectric layer 240 at positions overlapping in the stacking direction with the two terminals 180R. The terminals 180R and 280R are made using a conductive material (silver palladium, AgPd) that is the same as the individual electrodes 141 described below. Two through holes 181R are formed in the upper piezoelectric layer 140 at positions overlapping with the respective terminals 180R. Two through holes 281R are formed in the intermediate piezoelectric layer 240 at positions overlapping with the respective terminals 280R. The through holes 181R and 281R are positioned such that the through holes 181R communicate with the through holes 281R in the stacking direction. The two through holes 181R and 281R communicating with each other define through holes passing through the upper piezoelectric layer 140 and the intermediate piezoelectric layer 240. The through holes 181R and 281R are filled with the conductive material (silver palladium, AgPd) that is the same as the terminals 180R and 280R. The process of filling the through holes 181R and 281R with the conductive material and the process of forming the terminals 180R and 280R through a technique such as screen printing can be executed as a series of steps. The conductive material filled in the through holes 281R is conducted with the lower common electrode 341 (extending portion 343 described below, see FIG. 8). Namely, the lower common electrode 341 extends to the terminals 180R on the upper surface of the upper piezoelectric layer 140 through the conductive material filled in the through holes 281R and 181R.

As depicted in FIG. 5, two terminals 180L arranged in the conveyance direction are formed in the end 140L in the scanning direction of the upper piezoelectric layer 140. The terminals 180L are made using the same conductive material (silver palladium, AgPd) as the individual electrodes 141 and terminals 180R. Two through holes 181L are formed in the upper piezoelectric layer 140 at positions overlapping with the respective terminals 180L. The through holes 181L are filled with the same conductive material (silver palladium, AgPd) as the terminals 180L. The conductive material filled in the through holes 181L is conducted with the intermediate common electrode 241 (extending portion 243 described below, see FIG. 6). Namely, the intermediate common electrode 241 extends to the terminals 180L on the upper surface of the upper piezoelectric layer 140 through the conductive material filled in the through holes 181L.

The terminals 180L and 180R are respectively provided with bumps 182L and 182R that are connected to terminals (not depicted) of a Chip On Film (COF) 51 described below. When the bumps 182L and 182R are connected to the COF 51, predefined potential (e.g., 0V) can be supplied from the driver IC 58 to the intermediate common electrode 241 and the lower common electrode 341 via the COF 51.

<Individual Electrode 141>

As depicted in FIGS. 4A and 4B, each of the individual electrodes 141 is formed on the upper surface of the upper piezoelectric layer 140 at a position corresponding to the pressure chamber 26 pair. Namely, one individual electrode 141 is formed corresponding to two pressure chambers 26 forming the pressure chamber 26 pair (see FIG. 8A). The individual electrodes 141 are made, for example, using a conductive material such as silver palladium (AgPd), platinum (Pt), or iridium (Ir). The individual electrodes 141 of this embodiment are made using silver palladium (AgPd). As depicted in FIG. 5, four individual electrode rows 150 are formed corresponding to the eight pressure chamber rows 25. The four individual electrode rows 150 are arranged in the scanning direction. Each individual electrode row 150 includes 12 pieces of individual electrodes 141 arranged in the conveyance direction at a predefined pitch P. In the following, something disposed at the n-th position in the scanning direction from the end 140L of the upper piezoelectric layer 140 is simply referred to as the n-th something from the left. Similarly, something disposed at the n-th position in the scanning direction from the end 240L of the intermediate piezoelectric layer 240 (see FIG. 6) is simply referred to as the n-th something from the left, and something disposed at the n-th position in the scanning direction from the end 340L of the lower piezoelectric layer 340 (see FIG. 7) is simply referred to as the n-th something from the left.

The first individual electrode row 150 from the left among the four individual electrode rows 150 corresponds to the two pressure chamber rows 25 for black ink. The second individual electrode row 150 from the left corresponds to the two pressure chamber rows 25 for cyan ink. The third individual electrode row 150 from the left corresponds to the two pressure chamber rows 25 for magenta ink. The fourth individual electrode row 150 from the left corresponds to the two pressure chamber rows 25 for yellow ink.

Figure 8A:
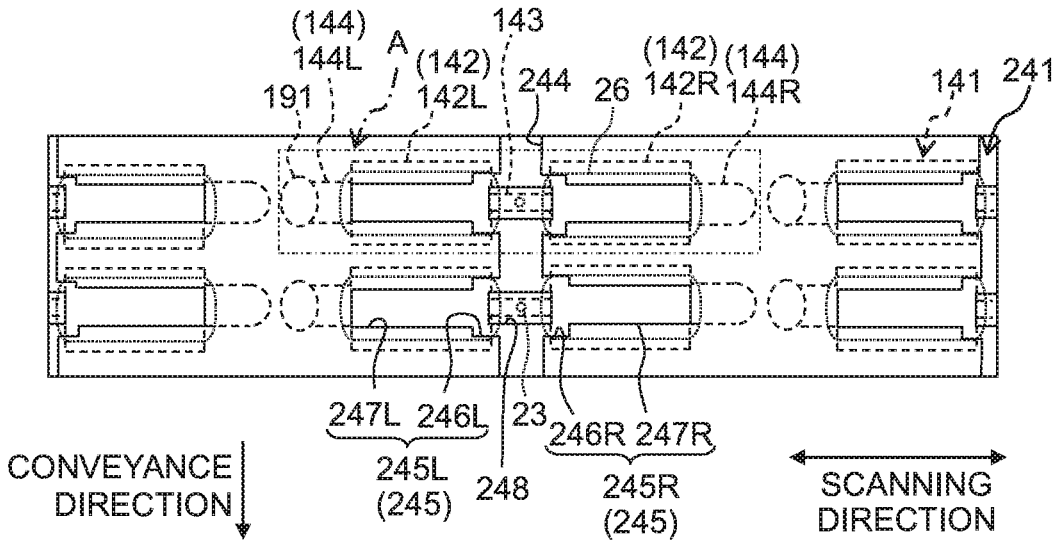
FIG. 8A schematically depicts a configuration in which the upper piezoelectric layer 140 overlaps with the intermediate piezoelectric layer 240 according to the embodiment.
Figure 8B:
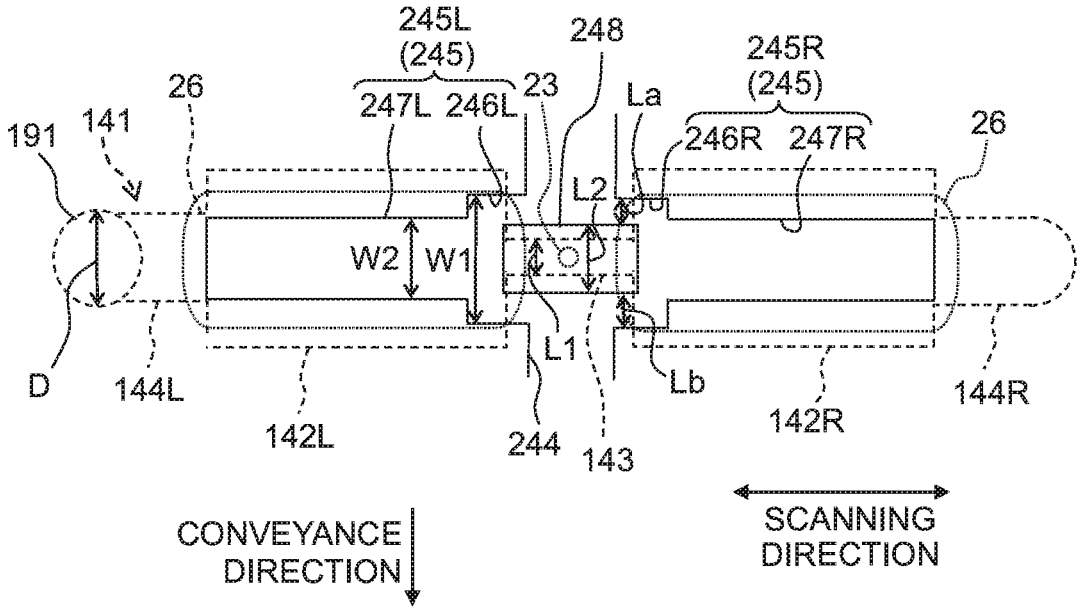
FIG. 8B is a partially enlarged view of an area A in FIG. 8A.

As depicted in FIGS. 5, 8A, and 8B, each individual electrode 141 includes two wide portions 142L and 142R arranged separately from each other in the left-right direction (scanning direction). The wide portion 142L is positioned between the end 140L and the wider portion 142R in the scanning direction. Each of the wide portions 142L and 142R has substantially a rectangular shape. Each individual electrode 141 includes a coupling portion 143 that couples the wide portion 142L with the wide portion 142R in the scanning direction, a narrow portion 144L extending from the wide portion 142L toward the end 140L in the scanning direction, and a narrow portion 144R extending from the wide portion 142R toward the end 140R in the scanning direction. The narrow portion 144L is provided with a bump 191 that is electrically joined to a contact (not depicted) provided in the COF 51 of the trace member 50 described below. The narrow portion 144R is provided with no bump 191. The wide portion 142L and the wide portion 142R are symmetric, and the narrow portion 144L and the narrow portion 144R are symmetric. In the following, when there is no need to distinguish between the left and the right, the wide portion 142L and the wide portion 142R may be collectively referred to as a wide portion 142, and the narrow portion 144L and the narrow portion 144R may be collectively referred to as a narrow portion 144.

<Intermediate Common Electrode 241>

As depicted in FIGS. 4A and 4B, the upper surface of the intermediate piezoelectric layer 240 is provided with the intermediate common electrode 241. As depicted in FIG. 6, the intermediate common electrode 241 includes: an extending portion 242 that extends in the scanning direction (left-right direction) to cover the end 240U in the conveyance direction of the intermediate piezoelectric layer 240; an extending portion 243 that extends in the conveyance direction to cover the end 240L in the scanning direction of the intermediate piezoelectric layer 240; four extending portions 244 that extend from the extending portion 242 toward the end 240D in the conveyance direction of the intermediate piezoelectric layer 240; protrusions 245L protruding from each extending portion 244 toward the end 240L in the scanning direction; and protrusions 245R protruding from each extending portion 244 toward the end 240R in the scanning direction. A substantially rectangular through hole 248 is formed to partially extend over the extending portion 244, the wide portions 246L, and the wide portion 246R of the intermediate common electrode 241. The intermediate piezoelectric layer 240 has multiple through holes 248 (see FIG. 8A).

The extending portion 242 and the extending portion 243 are positioned so that they do not overlap in the stacking direction with the pressure chambers 26 and the individual electrodes 141. As depicted in FIG. 8A, the extending portion 244 extends in the conveyance direction through an area between the wide portions 142L and 142R that are arranged adjacently to each other in the scanning direction so that the extending portion 244 does not overlap in the stacking direction with the wide portions 142L and 142R of the individual electrode 141. In FIG. 6, the first extending portion 244 from the left among the four extending portions 244 extends in the conveyance direction through an area in the scanning direction between the wide portions 142L and 142R of the individual electrodes 141 forming the first individual electrode row 150 from the left. Similarly, the second extending portion 244 from the left extends in the conveyance direction through an area in the scanning direction between the wide portions 142L and 142R of the individual electrodes 141 forming the second individual electrode row 150 from the left. The third extending portion 244 from the left extends in the conveyance direction through an area in the scanning direction between the wide portions 142L and 142R of the individual electrodes 141 forming the third individual electrode row 150 from the left. The fourth extending portion 244 from the left extends in the conveyance direction through an area in the scanning direction between the wide portions 142L and 142R of the individual electrodes 141 forming the fourth individual electrode row 150 from the left. The four extending portions 244 have the same width.

The protrusion 245L has the wide portion 246L and the narrow portion 247L. The protrusion 245R has the wide portion 246R and the narrow portion 247R. The protrusions 245L and 245R are symmetric, the wide portions 246L and 246R are symmetric, and the narrow portions 247L and 247R are symmetric. In the following, when there is no need to distinguish between the left and the right, the protrusions 245L and 245R may be collectively referred to as a protrusion 245, the wide portions 246L and 246R may be collectively referred to as a wide portion 246, and the narrow portions 247L and 247R may be collectively referred to as a narrow portion 247.

<Lower Common Electrode 341>

Figure 7:
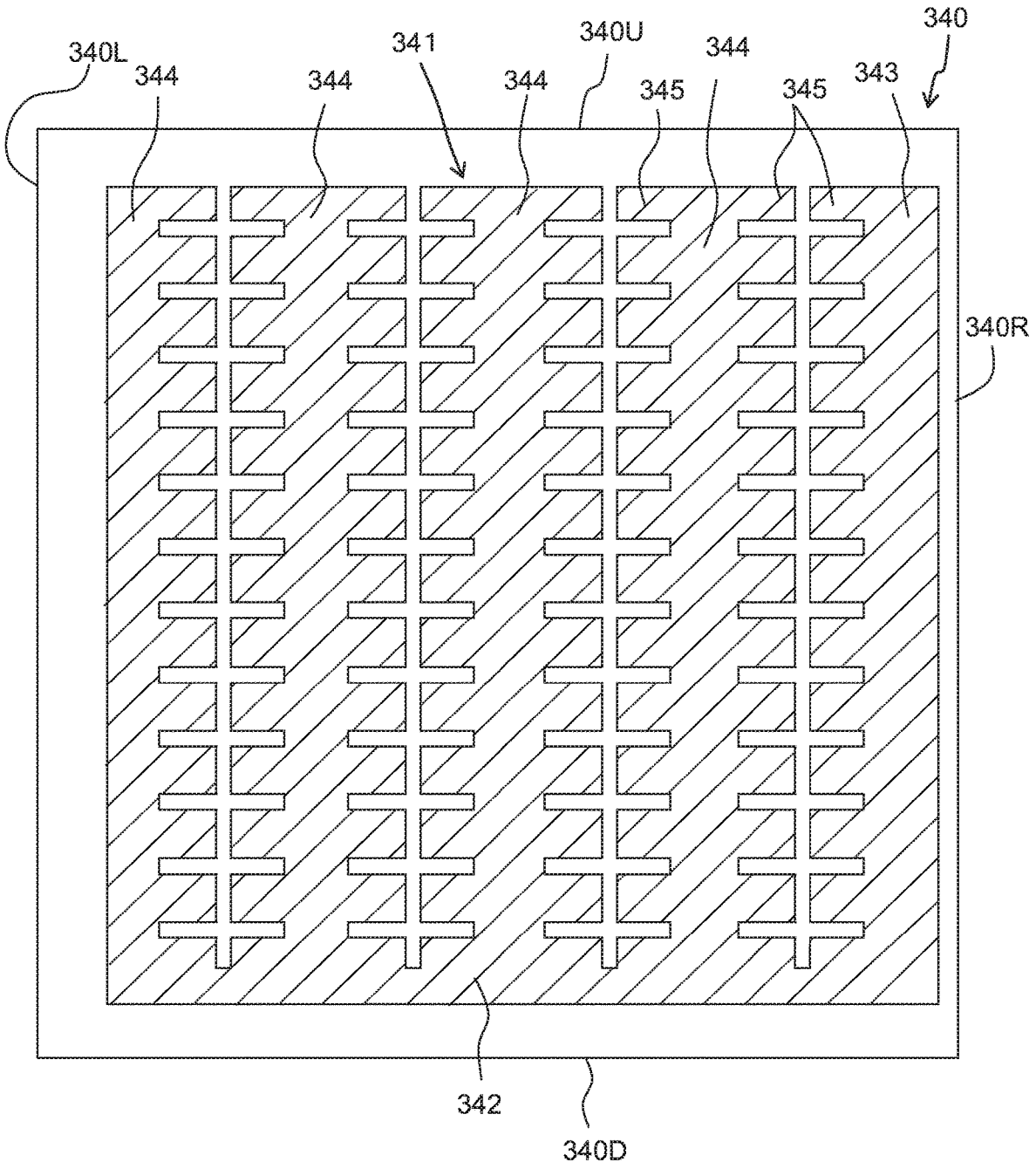
FIG. 7 is a top view of a lower piezoelectric layer 340 according to the embodiment.

As depicted in FIGS. 4A and 4B, the upper surface of the lower piezoelectric layer 340 is provided with the lower common electrode 341. As depicted in FIG. 7, the lower common electrode 341 includes: an extending portion 342 that extends in the scanning direction (left-right direction) to cover the end 340D in the conveyance direction of the lower piezoelectric layer 340; the extending portion 343 that extends in the conveyance direction to cover the end 340R in the scanning direction of the lower piezoelectric layer 340; four extending portions 344 that extend in the conveyance direction from the extending portion 342 toward the end 340U in the conveyance direction of the lower piezoelectric layer 340; and protrusions 345 that protrude from each extending portion 344 in the scanning direction. Of the four extending portions 344, the extending portion 344 closest to the end 340L in the scanning direction has protrusions 345 protruding toward the end 340R in the scanning direction. The remaining three extending portions 344 have protrusions 345 protruding toward both sides in the scanning direction. Further, the protrusions 345 protrude in the scanning direction from the extending portion 343 toward the end 340L in the scanning direction of the lower piezoelectric layer 340. The extending portion 342 is positioned so that it does not overlap in the stacking direction with the pressure chambers 26 and the individual electrodes 141. Further, the extending portion 342 is positioned so that it does not overlap in the stacking direction with the intermediate common electrode 241.

Figure 9:
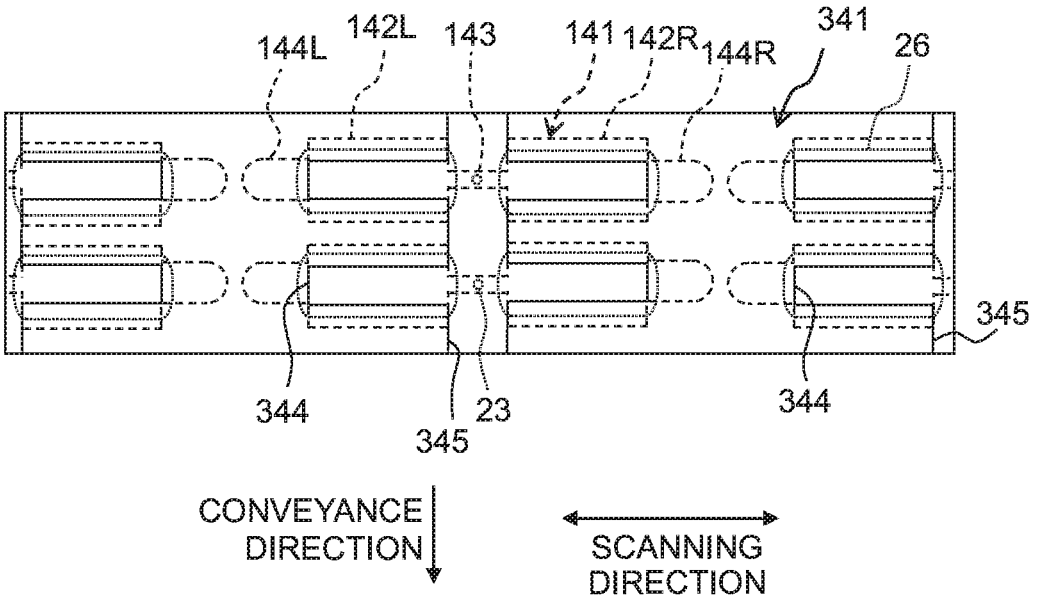
FIG. 9 schematically depicts a configuration in which the upper piezoelectric layer 140 overlaps with the lower piezoelectric layer 340 according to the embodiment, FIG. 10A schematically depicts deformation of a COF 51 in a case in which bumps 191 are disposed in a narrow portion 144L and a bump 191 different from said bumps 191 is disposed in a narrow portion 144R, and FIG. 10B schematically depicts deformation of the COF 51 in a case in which each bump 191 is disposed in one of the narrowing portions 144L and 144R.

The four extending portions 344 extend in the conveyance direction through an area between the individual electrodes 141 forming two individual electrode rows 150 that are arranged adjacently to each other in the scanning direction so that the four extending portions 344 do not overlap in the stacking direction with the wide portions 142 of the individual electrodes 141 forming the individual electrode rows 150 (see FIG. 9).

Referring to FIGS. 8A and 8B, the positional relationship between the pressure chamber 26, the individual electrode 141, and the intermediate common electrode 241 is explained below. FIG. 8B is a partially enlarged view of an area A in FIG. 8A. In FIG. 8B, the intermediate common electrode 241 formed in the intermediate piezoelectric layer 240 is indicated by solid lines and the pressure chamber 26, the individual electrode 141, the bump 191, and the like are indicated by broken lines for the purpose of easy understanding.

The pressure chamber 26 is longer in the scanning direction than the wide portion 142 (wide portions 142L and 142R) of the individual electrode 141. The total length in the scanning direction of the wide portion 142 and the narrow portion 144 is longer than the length in the scanning direction of the pressure chamber 26. The length in the scanning direction of the protrusion 245 of the intermediate common electrode 241 is substantially the same as the length in the scanning direction of the wide portion 142 of the individual electrode 141.

As depicted in FIG. 8B, a length W1 in the conveyance direction of the wide portion 246 of the protrusion 245 is substantially the same as the length in the conveyance direction of the pressure chamber 26. A length W2 in the conveyance direction of the narrow portion 247 of the protrusion 245 is smaller than the length W1 in the conveyance direction of the wide portion 246 (W2<W1). The length L1 in the conveyance direction of the coupling portion 143 of the individual electrode 141 is smaller than the length L2 in the conveyance direction of the through hole 248. The length in the scanning direction of the coupling portion 143 of the individual electrode 141 is substantially the same as the length in the scanning direction of the through hole 248. The coupling portion 143 of the individual electrode 141 thus overlaps in the stacking direction with the through hole 248, and the coupling portion 143 of the individual electrode 141 does not overlap in the stacking direction with the intermediate common electrode 241.

As depicted in FIG. 8B, a distance La between an end close to the end 240U of the through hole 248 and an end close to the end 240U of the wide portion 246 is the same as a distance Lb between an end close to the end 240D of the through hole 248 and an end close to the end 240D of the wide portion 246 (La=Lb). The sum (La+Lb=2La) of the distance La and the distance Lb is longer than the length L1 in the conveyance direction of the coupling portion 143. The length D in the conveyance direction of the bump 191 is longer than the length L2 in the conveyance direction of the opening 143.

The nozzle 23 is positioned at substantially a center portion of the individual electrode 141 (substantially a center portion of the coupling portion 143 of the individual electrode 141). In other words, the nozzle 23 is positioned at an area between two pressure chambers 26 corresponding to one individual electrode 141 in the scanning direction. The nozzle 23 is positioned at substantially a center portion of the individual electrode 141 (substantially a center portion of the coupling portion 143 of the individual electrode 141) in the conveyance direction.

A center position in the conveyance direction of the protrusion 245 of the intermediate common electrode 241, a center position in the conveyance direction of the pressure chamber 26, and a center position in the conveyance direction of the wide portion 142 of the individual electrode 141 are substantially identical to each other in the conveyance direction. The pressure chamber 26 is longer in the conveyance direction than the narrow portion 247 of the intermediate common electrode 241. The ratio of the length in the conveyance direction of the pressure chamber 26 to the length in the conveyance direction of the narrow portion 247 of the intermediate common electrode 241 is approximately 2:1. In that configuration, both ends (approximately one-fourth of the length in the conveyance direction of the pressure chamber) in the conveyance direction of the pressure chamber 26 do not overlap in the stacking direction with the protrusions 245 of the intermediate common electrode 241. The wide portion 142 of the individual electrode 141 is longer in the conveyance direction than the pressure chamber 26.

Referring to FIG. 9, the positional relationship between the pressure chamber 26 and the individual electrode 141 and the lower common electrode 341 is explained. In FIG. 9, the lower common electrode 341 formed in the lower piezoelectric layer 340 are depicted by solid lines, and the pressure chambers 26, the individual electrodes 141, the bumps 191, and the like are depicted by broken lines, for the purpose of easy understanding.

The length in the scanning direction of the protrusion 345 of the lower common electrode 341 is substantially the same as the length in the scanning direction of the wide portion 142 of the individual electrode 141. The positions in the scanning direction of inner ends of two pressure chambers 26 corresponding to one individual electrode 141 are substantially the same as the positions in the scanning direction of protruding ends in the scanning direction of the protrusions 345 of the lower common electrode 341. The positions in the scanning direction of outer ends of two pressure chambers 26 corresponding to one individual electrode 141 are substantially the same as the positions in the scanning direction of ends in the scanning direction of the extending portion 344 of the lower common electrode 341.

The positions in the scanning direction of outer ends in the scanning direction of the wide portions 142 are substantially the same as the positions in the scanning direction of protruding ends in the scanning direction of the protrusions 245 of the intermediate common electrode 241 (see FIG. 8A). In that configuration, the protrusions 245 of the intermediate common electrode 241 do not overlap in the stacking direction with the extending portions 344 of the lower common electrode 341. Further, the protrusions 345 of the lower common electrode 341 overlap in the scanning direction with the extending portions 244 of the intermediate common electrode 241.

A center position in the conveyance direction of the protrusion 345 of the lower common electrode 341 is substantially the same as a center position in the conveyance direction of an area between two pressure chambers 26 arranged adjacently to each other in the conveyance direction. The length in the conveyance direction of the area between the two pressure chambers 26 arranged adjacently to each other in the conveyance direction is shorter than the length in the conveyance direction of the protrusion 345 of the lower common electrode 341. In that configuration, both ends in the conveyance direction of the pressure chamber 26 overlap in the stacking direction with the protrusion 345 of the lower common electrode 341. The length in the conveyance direction of the overlap portion in the stacking direction of the pressure chamber 26 with the protrusion 345 of the lower common electrode 341 is shorter than one-fourth of the length in the conveyance direction of the pressure chamber 26. As described above, in both ends in the conveyance direction of the pressure chamber 26, approximately one-fourth of the length in the conveyance direction of the pressure chamber 26 does not overlap in the stacking direction with the protrusion 245 of the intermediate common electrode 241. Thus, each protrusion 345 of the lower common electrode 341 does not overlap in the stacking direction with each protrusion 245 of the intermediate common electrode 241.

As described above, the center position in the conveyance direction of the pressure chamber 26 is substantially the same, in the conveyance direction, as the center position in the conveyance direction of the wide portion 142 of the individual electrode 141. The wide portion 142 of the individual electrode 141 is longer in the conveyance direction than the pressure chamber 26. In that configuration, both ends in the conveyance direction of the wide portion 142 overlap in the stacking direction with the protrusion 345 of the lower common electrode 341. The length in the conveyance direction of the overlap portion in the stacking direction of the wide portion 142 with the protrusion 345 of the lower common electrode 341 is longer than the length in the conveyance direction of the overlap portion in the stacking direction of the pressure chamber 26 with the protrusion 345 of the lower common electrode 341.

<Trace Member 50>

As depicted in FIG. 2, the trace member 50 includes the COF 51 and the driver IC 58 disposed on the COF 51. Contacts (not depicted) in the COF 51 are electrically connected to the bumps 191 (see, for example, FIG. 5) in the narrow portions 144L of the individual electrodes 141, which makes it possible to set the potential for each of the individual electrodes 141. As described above, the driver IC 58 can set predefined constant potential for the intermediate common electrode 241 and the lower common electrode 341.

<Driving of Piezoelectric Element 401>

The piezoelectric body 40 is a substantially rectangular plate-like member in a planar view (see, for example, FIG. 2) that is disposed on the vibration plate 30 to cover the pressure chambers 26. The piezoelectric body 40 includes multiple piezoelectric elements 401 each of which corresponds to two pressure chambers 26. The driving of the piezoelectric element 401 is explained below. A portion included in the upper piezoelectric layer 140 and interposed between the individual electrode 141 and the intermediate common electrode 241 in the stacking direction (hereinafter referred to as a first active portion 41, see FIGS. 4A and 4B) is polarized in the stacking direction. A portion included in the upper piezoelectric layer 140 and the intermediate piezoelectric layer 240 and interposed between the individual electrode 141 and the lower common electrode 341 in the stacking direction (hereinafter referred to as a second active portion 42, see FIGS. 4A and 4B) is polarized in the stacking direction. Predefined first potential (e.g., 24V) is constantly applied to the intermediate common electrode 241 and predefined second potential (e.g., 0V) is constantly applied to the lower common electrode 341, in a state where the driver IC 58 is energized. Each of the first potential and the second potential is selectively applied to each individual electrode 141. Specifically, when no ink is discharged from two pressure chambers 26 corresponding to one individual electrode 141, the second potential is applied to the one individual electrode 141. In that situation, there is no difference in potential between the individual electrode 141 and the lower common electrode 341, and thus the second active portion 42 is not deformed. On the other hand, the potential difference between the first potential and the second potential (here, 24V) is generated between the individual electrode 141 and the intermediate common electrode 241. This deforms the first active portion 41 to be convex downward (toward the pressure chamber 26).

When ink is discharged from two pressure chambers 26 corresponding to one individual electrode 141, the first potential is applied to the individual electrode 141 and then the potential to be applied returns to the second potential. Namely, a pulse-like voltage signal, in which the potential increases from the second potential to the first potential and the potential returns to the second potential after predefined time is elapsed, is applied to the individual electrode 141. When the first potential is applied to the individual electrode 141, the difference in potential between the individual electrode 141 and the intermediate common electrode 241 is eliminated. This makes the first active portion 41 that is deformed to be convex downward (pressure chamber 26 side) return to its original state. In that situation, the first active portion 41 is deformed upward, increasing the volume of the pressure chambers 26. When the first active portion 41 is deformed upward, the difference in potential between the individual electrode 141 and the lower common electrode 341 (here, 24V) is caused to deform the second active portion 42. The deformation of the second active portion 42 moves center portions of the pressure chambers 26 upward, thus making the increase in volume of the pressure chambers 26 large. When the potential of the individual electrode 141 has returned to the second potential, the difference in potential between the individual electrode 141 and the lower common electrode 341 is eliminated and the second active portion 42 returns to its original state. On the other hand, the potential difference between the first potential and the second potential (here, 24V) is generated between the individual electrode 141 and the intermediate common electrode 241. The first active portion 41 is thus deformed to be convex downward (pressure chamber 26 side). The deformation of the first active portion 41 applies pressure to two pressure chambers 26, discharging ink in the two pressure chambers 26 from the nozzle 23 communicating with the two pressure chambers 26.

<Technical Effects of the Embodiment>

In the above embodiment, one individual electrode 141 is provided corresponding to two pressure chambers 26. The wide portions 142L and 142R of the individual electrode 141 are arranged to overlap in the stacking direction with the two pressure chambers 26, respectively. The coupling portion 143 couples the wide portion 142L with the wide portion 142R, and thus applying predefined voltage to one individual electrode 141 allows ink to be simultaneously discharged from the two pressure chambers 26 to the corresponding nozzle 23. This results in a sufficient ink amount for ink discharge.

As depicted in FIG. 4A, the coupling portion 143 overlaps in the stacking direction with the wall partitioning two pressure chambers 26. When the piezoelectric body 40 is joined to the stacked body 60 so that they overlap with each other in the stacking direction, foreign matter, such as dust, may be interposed therebetween. In that case, the piezoelectric body 40 is liable to be joined to the stacked body 60 in a state where the foreign matter is present on the coupling portion 143. This may crack a piezoelectric material layer positioned below the coupling portion 143 because pressure caused when the stacked body 60 is pressed against the piezoelectric body 40 can not escape owing to the wall disposed below the coupling portion 143 and partitioning two pressure chambers 26. If the intermediate common electrode 241 has no through holes 248, an electrical field between the coupling portion 143 and the intermediate common electrode 241 that is high in the stacking direction would occur when predefined voltage is applied to the individual electrode 141. If the piezoelectric material layer positioned below the coupling portion 143 is cracked, a short circuit between the coupling portion 143 and the intermediate common electrode 241 may occur via the crack.

In this embodiment, the through holes 248 are formed in the areas of the intermediate common electrode 241 overlapping in the stacking direction with the coupling portions 143, and thus the coupling portions 143 do not overlap in the stacking direction with the intermediate common electrode 241. In that configuration, when predefined voltage is applied to the individual electrode 141, the electric field between the coupling portion 143 and the intermediate common electrode 241 that is high in the stacking direction is not likely to occur. Even when the piezoelectric material layer positioned below the coupling portion 143 is cracked as described above, it is possible to reduce the possibility of breakdown via the crack and to increase the reliability of electrical connection between the piezoelectric body 40 and the COF 51.

In general, when the piezoelectric body 40 is formed having a metal film, such as the individual electrode 141, residual stress remaining on the metal film is larger than residual stress remaining on the piezoelectric material layer after baking. This causes a warp or warpage of the piezoelectric body 40. Especially, when the dimension of the metal film on the piezoelectric body 40 is large, like the individual electrode 141, the piezoelectric body 40 is greatly warped. The length L1 in the conveyance direction of the coupling portion 143 is thus preferably short. In order to stably supply electrical charge in the intermediate common electrode 241, the sum (La+Lb) of the distance La between the end close to the end 240U of the through hole 248 and the end close to the end 240U of the wide portion 246 and the distance Lb between the end close to the end 240D of the through hole 248 and the end close to the end 240D of the wide portion 246 is preferably large. Thus, in this embodiment, the sum of the distance La and the distance Lb is made to be larger than the length L1 in the conveyance direction of the coupling portion 143 (L1<La+Lb, L1<2La). This stably supplies electrical charge in the intermediate common electrode 241 while reducing the warp of the piezoelectric body 40. When the individual electrode 141 is formed through printing by use of a mask, the length L1 in the conveyance direction of the coupling portion 143 is preferably equal to or more than 60 μm due to manufacturing reasons.

Figure 10A:
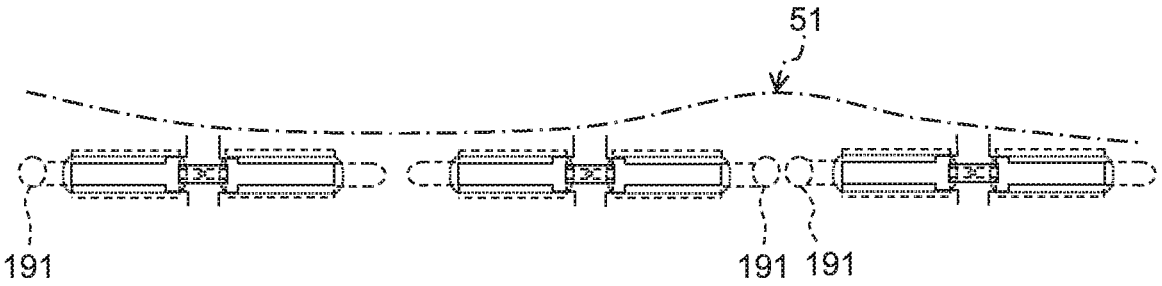
Figure 10B:
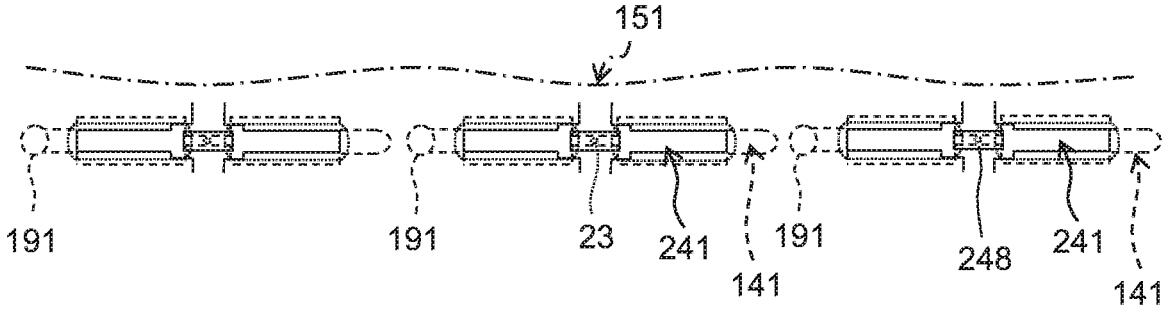

In the above embodiment, the individual electrode 141 includes the two narrow portions 144L and 144R. As depicted in FIG. 10B, the bump 191 is provided in one of the narrow portions 144L and 144R (the narrow portion 144L in this embodiment). Dot-dash chains lines in FIGS. 10A and 10B schematically depict deformation of the COF 51 when seen from a direction orthogonal to the stacking direction. It is assumed that some of the bumps 191 are provided in the narrow portions 144L and some of the bumps 191 different from said bumps 191 are provided in the narrow portions 144R, as depicted in FIG. 10A. This configuration includes a portion having a long distance between bumps 191 adjacent to each other in the scanning direction and a portion having a short distance between bumps 191 adjacent to each other in the scanning direction. The bumps 191 have a predefined height in the stacking direction. Thus, when the COF 51 is joined to the bumps 191, portions of the COF 51 overlapping with the bumps 191 have a space in the stacking direction between the COF 51 and the piezoelectric body 40. However, a portion of the COF 51 between two bumps 191 arranged adjacently to each other in the scanning direction is deformed downward to approach the piezoelectric body 40. The COF 51 is more greatly deformed to approach the piezoelectric body 40 at the portion having the long distance between bumps 191 adjacent to each other in the scanning direction than at the portion having the short distance between bumps 191 adjacent to each other in the scanning direction. This may cause the COF 51 to make contact with the piezoelectric body 40, interfering with deformation of the piezoelectric element 401.

In contrast, when the bump 191 is provided in one of the narrow portions 144L and 144R as depicted in FIG. 10B, there is no portion having the long distance between bumps 191 adjacent to each other in the scanning direction as depicted in FIG. 10A. The COF 51 is thus not likely to interfere with deformation of the piezoelectric element 401 by making contact with the piezoelectric body 40.

In the above embodiment, one of the narrow portions 144 (e.g., the narrow portion 144R) is not provided with the bump 191. The narrow portion 144 included in the two narrow portions 144 and provided with no bump 191 may thus be removed from the individual electrode 141. In this embodiment, however, the individual electrode 141 includes the narrow portions 144 provided with no bumps 191, which makes the individual electrode 141 symmetric. Deformation of the piezoelectric element 401 can thus affect the two piezoelectric chambers 26 corresponding to one individual electrode 141 uniformly, making it possible to improve discharge characteristics of the ink-jet head.

In the above embodiment, the bump 191 is provided in one of the narrow portions 144, and no bump 191 is provided at a barycentric position of the individual electrode 141. When the bump 191 is provided at the barycentric position of the individual electrode 141, electrical charge is easily and uniformly supplied to two wide portions 142 of the individual electrode 141 separated from each other in the scanning direction. In this embodiment, however, the coupling portion 143 is on the barycentric position of the individual electrode 141. When the bump 191 is provided at the coupling portion 143, the bump 191 preferably does not overlap in the stacking direction with the intermediate common electrode 241 for the same reason as the case in which the coupling portion 143 is provided not to overlap in the stacking direction with the intermediate common electrode 241. Namely, the length D in the conveyance direction of the bump 191 is preferably shorter than the length L2 in the conveyance direction of the opening 143. However, manufacturing variability in the bump 191 may make the length D in the conveyance direction of the bump 191 longer than the length L2 in the conveyance direction of the opening 143. In that case, the bump 191 may overlap in the stacking direction with the intermediate common electrode 241. In view of the above, the bump 191 is provided at one of the narrow portions 144 instead of at the barycentric position of the individual electrode 141 in the above embodiment. Since the bump 191 is provided in one of the narrow portions 144, the length D in the conveyance direction of the bump 191 can be longer than the length L2 in the conveyance direction of the opening 143. This improves the reliability of electrical connection between the piezoelectric body 40 and the COF 51.

Modified Embodiment

In the above embodiment, the distance La between the end close to the end 240U of the through hole 248 and the end close to the end 240U of the wide portion 246 is the same as the distance Lb between the end close to the end 240D of the through hole 248 and the end close to the end 240D of the wide portion 246 (La=Lb). The present disclosure, however, is not limited thereto, and the distance La may be different from the distance Lb. When electrical charge is supplied from the side close to the end 240U to the intermediate common electrode 241 in the modified embodiment, the distance La between the end close to the end 240U of the through hole 248 and the end close to the end 240U of the wide portion 246 can be longer than the distance Lb between the end close to the end 240D of the through hole 248 and the end close to the end 240D of the wide portion 246 (La>Lb). In this case, electrical charge flowing through the extending portion 244 from the end 240U toward the end 240D can be efficiently supplied to each protrusion 245.

Figure 11:
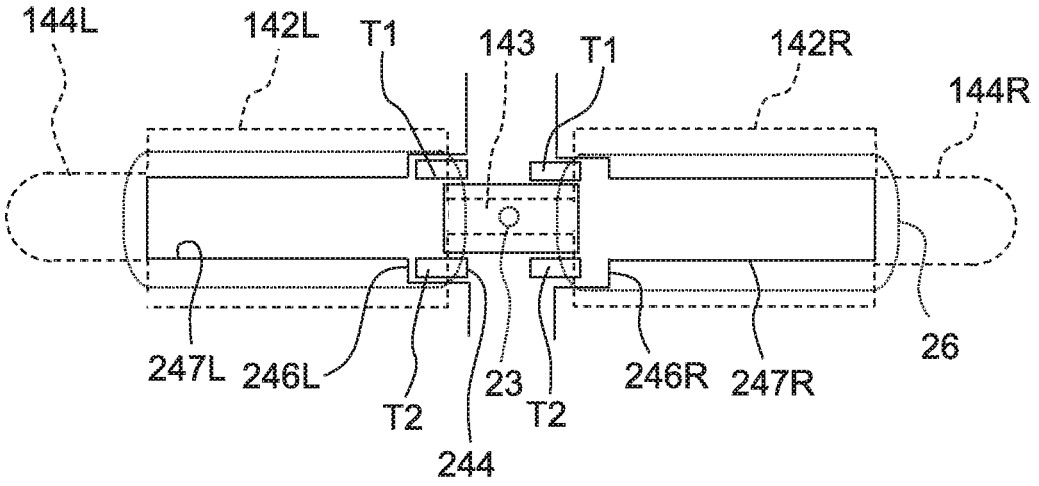
FIG. 11 schematically depicts a case in which thickness of an intermediate common electrode 241 is partially increased.

In the above embodiment, the thickness in the stacking direction of the intermediate common electrode 241 is uniform. The present disclosure, however, is not limited thereto. For example, as depicted in FIG. 11, the thickness in the stacking direction of a portion (area T1 in FIG. 11) included in the intermediate common electrode 241 and positioned between the end close to the end 240U of the through hole 248 and the end close to the end 240U of the wide portion 246 and the thickness in the stacking direction of a portion (area T2 in FIG. 11) included in the intermediate common electrode 241 and positioned between the end close to the end 240D of the through hole 248 and the end close to the end 240D of the wide portion 246 can be thicker than the thickness of other portions of the intermediate common electrode 241. This allows electrical charge flowing through the extending portion 244 to be efficiently supplied to each protrusion 245. When the intermediate common electrode 241 is formed through screen printing, the areas T1 and T2 can be subjected to double coating to make the thickness of the areas T1 and T2 thicker than that of the other portions.

Figure 12:
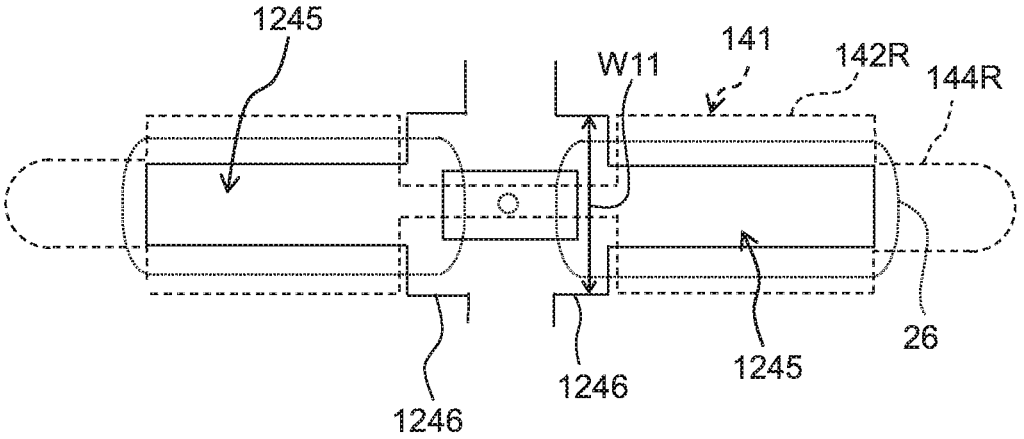
FIG. 12 schematically illustrates a case in which a length W11 in the conveyance direction of a wide portion 1246 of a protrusion 1245 is longer than a length in the conveyance direction of a pressure chamber 26.

In the above embodiment, the length W1 in the conveyance direction of the wide portion 246 is substantially the same as the length in the conveyance direction of the pressure chamber 26. The present disclosure, however, is not limited thereto. For example, as depicted in FIG. 12, a length W11 in the conveyance direction of a wide portion 1246 of a protrusion 1245 can be longer than the length in the conveyance direction of the pressure chamber 26. When part of the wide portion 1246 extending beyond the pressure chamber 26 in the conveyance direction overlaps in the stacking direction with the individual electrode 141, a short circuit may occur between the individual electrode 141 and the part of the wide portion 1246 extending beyond the pressure chamber 26 in the conveyance direction for the same reason as described above. The configuration in FIG. 12 thus makes the length in the scanning direction of the wide portion 142 of the individual electrode 141 short so that the part of the wide portion 1246 extending beyond the pressure chamber 26 in the conveyance direction does not overlap in the stacking direction with the individual electrode 141. In that configuration, electrical charge flowing through the extending portion 244 can be efficiently supplied to each protrusion 1245 via the wide portion 1246 while inhibiting the short circuit between the part of the wide portion 1246 extending beyond the pressure chamber 26 in the conveyance direction and the individual electrode 141. The length in the scanning direction of the wide portion 142 of the individual electrode 141 can be reduced to a length approximately 90% of the length in the scanning direction of the pressure chamber 26.

In the above embodiment, the piezoelectric body 40 has three piezoelectric layers and the upper surface of each of the piezoelectric layers is formed having the electrode(s). The present disclosure, however, is not limited thereto. The piezoelectric body may have two or more or three or more piezoelectric layers and a lower surface of each of the piezoelectric layers may be formed having the electrode(s). In the above embodiment, the piezoelectric body has two common electrodes (the intermediate common electrode and the lower common electrode). The present disclosure, however, is not limited thereto. The piezoelectric body may have only one common electrode. The shape of the common electrode (the shape of the extending portions and the shape of the protrusions) may be determined as needed. In the above embodiment, the individual electrode 141 has the wide portions 142 and the narrow portions 144. The shape of the individual electrode is not necessarily limited thereto. For example, the width in the conveyance direction of the individual electrode may be uniform in the scanning direction. The number of individual electrode rows, the number of individual electrodes per one individual electrode row, the pitch in the scanning direction of individual electrodes, the amount of shift in the scanning direction of adjacent individual electrode rows, and the like may be determined as appropriate without being limited to the examples in the above embodiment. In other words, the number of pressure chamber rows, the number of pressure chambers per one pressure chamber row, the pitch in the scanning direction of pressure chambers, the amount of shift in the scanning direction of adjacent pressure chamber rows, and the like may be determined as appropriate without being limited to the examples in the above embodiment.

Although one individual electrode is provided corresponding to two pressure chambers in the above embodiment, one individual electrode may be provided corresponding to three or more pressure chambers. Although one nozzle is provided corresponding to two pressure chambers in the above embodiment, one nozzle may be provided corresponding to one pressure chamber. Further, in the above embodiment, ink is supplied from the same manifold to two pressure chambers corresponding to one individual electrode. However, ink may be supplied from different manifolds to two pressure chambers corresponding to one individual electrode. In that configuration, ink may be supplied from one ink cartridge to multiple manifolds through which ink is supplied to two pressure chambers. Or, ink may be supplied from different ink cartridges to multiple manifolds through which ink is supplied to two pressure chambers. Alternatively, ink supplied to multiple manifolds may be circulated.

The embodiment and modified embodiments can be combined as appropriate. The embodiment and modified embodiments are examples in which the present disclosure is applied to the ink-jet head 5 configured to perform printing of an image or the like by discharging ink on a recording sheet. In the above embodiment, the ink-jet head 5 is a serial-type ink-jet head. The present disclosure, however, is not limited thereto. The present disclosure is applicable to a line-type ink-jet head. The present disclosure is not limited to the ink-jet head configured to discharge ink. The present disclosure is applicable to liquid discharge apparatuses for various uses except for the printing of an image or the like. For example, the present disclosure is applicable to a liquid discharge apparatus configured to form a conductive pattern on a surface of a substrate by discharging a conductive liquid on the substrate.

What is claimed is:

1. A liquid discharge head, comprising:

a piezoelectric body including a plurality of piezoelectric layers stacked in a stacking direction, the piezoelectric body having a first end and a second end which are away from each other in a first direction orthogonal to the stacking direction of the piezoelectric layers;

a plurality of individual electrodes located on a first surface that is orthogonal to the stacking direction; and a first common electrode located on a second surface that is orthogonal to the stacking direction, the first common electrode being different in a position in the stacking direction from the first surface, wherein each of the individual electrodes includes a first portion and a second portion arranged in the first direction at an interval, and a third portion connecting the first portion and the second portion, the first portion being positioned between the first end and the third portion in the first direction, the third portion being positioned between the first portion and the second portion in the first direction, the second portion being positioned between the third portion and the second end in the first direction, wherein the first portions, the second portions, and the third portions of the individual electrodes are arranged between the first end and the second end to form rows along a second direction orthogonal to the stacking direction and intersecting with the first direction, thus forming a first portion row, a second portion row, and a third portion row, wherein each of the individual electrodes are configured to be supplied a voltage selectively, wherein the first common electrode overlaps with both the first portion row and the second portion row in the stacking direction, and wherein the first common electrode is configured to be supplied a constant voltage constantly.

2. The liquid discharge head according to claim 1, wherein the first common electrode includes: a first extending portion extending in the second direction to pass through a position between the first portion row and the second portion row in the first direction; a plurality of first protrusions protruding from the first extending portion toward the first end; and a plurality of second protrusions protruding from the first extending portion toward the second end, wherein each of the first protrusions partially overlaps in the stacking direction with one of the first portions of the individual electrodes forming the first portion row, and wherein each of the second protrusions partially overlaps in the stacking direction with one of the second portions of the individual electrodes forming the second portion row.

3. The liquid discharge head according to claim 2, wherein portions of the first extending portion overlapping in the stacking direction with the third portions are formed having through holes passing through the first common electrode in the stacking direction.

4. The liquid discharge head according to claim 2, wherein the second extending portion does not have the through hole.

5. The liquid discharge head according to claim 2, further comprising a channel unit that includes:

a plurality of pressure chambers including a plurality of first pressure chambers corresponding to the first portions and a plurality of second pressure chambers corresponding to the second portions;

a plurality of nozzles corresponding to the pressure chambers; and a plurality of channels allowing the pressure chambers to communicate with the nozzles.

6. The liquid discharge head according to claim 5, wherein the nozzles include a plurality of first nozzles corresponding to the first pressure chambers and a plurality of second nozzles corresponding to the second pressure chambers, and wherein the channels include a plurality of first channels allowing the first pressure chambers to communicate with the first nozzles corresponding thereto and a plurality of second channels allowing the second pressure chambers to communicate with the second nozzles corresponding thereto.

7. The liquid discharge head according to claim 5, wherein each of the channels allows one of the first pressure chambers corresponding to the first portions of the individual electrodes to communicate with one of the second pressure chambers corresponding to the second portions of the individual electrodes, and each of the channels communicates with one of the nozzles.

8. The liquid discharge head according to claim 5, wherein each of the first protrusions and each of the second protrusions includes a wide portion and a narrow portion, and a length in the second direction of the wide portion is longer than a length in the second direction of the narrow portion, and wherein each of the through holes is formed to extend over part of the wide portion of each of the first protrusions and part of the wide portion of each of the second protrusions.

9. The liquid discharge head according to claim 8, wherein the length in the second direction of the wide portion is longer than a length in the second direction of each of the pressure chambers, and wherein the length in the second direction of the narrow portion is shorter than the length in the second direction of each of the pressure chambers.

10. The liquid discharge head according to claim 9, wherein part of the wide portion overlaps in the stacking direction with each of the pressure chambers, and the wide portion does not overlap in the stacking direction with the first portion and the second portion.

11. The liquid discharge head according to claim 8, wherein a sum total of lengths in the second direction of portions included in each of the wide portions and formed having the through hole is larger than a length in the second direction of each of the second portions.

12. The liquid discharge head according to claim 8, wherein a portion of each of the wide portions formed having the through hole is shifted to one side in the second direction.

13. The liquid discharge head according to claim 8, wherein a thickness in the stacking direction of a portion included in each of the wide portions and having a position in the second direction that is the same as a position in the second direction of the through hole is thicker than a thickness of each of the narrow portions.

14. The liquid discharge head according to claim 5, wherein each of the first portions includes a first overlapping portion overlapping in the stacking direction with one of the first pressure chambers and a first non-overlapping portion not overlapping in the stacking direction with the first pressure chambers, and the first non-overlapping portion is positioned between the first end and the first overlapping portion in the first direction, wherein each of the second portions includes a second overlapping portion overlapping in the stacking direction with one of the second pressure chambers and a second non-overlapping portion not overlapping in the stacking direction with the second pressure chambers, and the second non-overlapping portion is positioned between the second end and the second overlapping portion in the first direction, and wherein the liquid discharge head further comprises:

a trace member disposed to overlap in the stacking direction with the piezoelectric body and including a plurality of first terminals that are electrically connected to the first non-overlapping portions of the first portions of the individual electrodes; and a plurality of conductive material layers disposed between the first non-overlapping portions and the first end in the stacking direction.

15. The liquid discharge head according to claim 14, wherein the conductive material layers are not disposed between the second non-overlapping portions and the trace member in the stacking direction.

16. The liquid discharge head according to claim 14, wherein a length in the second direction of each of the conductive material layers is longer than a length in the second direction of each of the through holes.

17. The liquid discharge head according to claim 14, wherein each of the individual electrodes includes:

a fourth portion and a fifth portion arranged in the first direction at an interval; and a sixth portion connecting the fourth portion and the fifth portion, the fourth portion being positioned between the second portion and the sixth portion in the first direction, the sixth portion being positioned between the fourth portion and the fifth portion in the first direction, the fifth portion being positioned between the sixth portion and the second end in the first direction, wherein the fourth portions, the fifth portions, and the sixth portions of the individual electrodes are arranged to form rows along the second direction, thus forming a fourth portion row, a fifth portion row, and a sixth portion row, wherein the first common electrode includes: a second extending portion extending in the second direction to pass through a position between the fourth portion row and the fifth portion row in the first direction; a plurality of third protrusions protruding from the second extending portion toward the first end; and a plurality of fourth protrusions protruding from the first extending portion toward the second end, wherein each of the third protrusions partially overlaps in the stacking direction with one of the fourth portions of the individual electrodes forming the fourth portion row, wherein each of the fourth protrusions partially overlaps in the stacking direction with one of the fifth portions of the individual electrodes forming the fifth portion row, wherein portions of the second extending portion overlapping in the stacking direction with the fourth portions are formed having through holes passing through the first common electrode in the stacking direction, wherein the pressure chambers include a plurality of third pressure chambers corresponding to the fourth portions and a plurality of fourth pressure chambers corresponding to the fifth portions, wherein each of the fourth portions includes a third overlapping portion overlapping in the stacking direction with one of the third pressure chambers and a third non-overlapping portion not overlapping in the stacking direction with the third pressure chambers, and the third non-overlapping portion is positioned between the second non-overlapping portion and the third overlapping portion in the first direction, wherein each of the fifth portions includes a fourth overlapping portion overlapping in the stacking direction with one of the fourth pressure chambers and a fourth non-overlapping portion not overlapping in the stacking direction with the fourth pressure chambers, and the second non-overlapping portion is positioned between the fourth overlapping portion and the second end in the first direction, wherein the trace member includes a plurality of second terminals that are electrically connected to the third non-overlapping portions of the fourth portions of the individual electrodes, and wherein part of the conductive material layers is disposed between the third non-overlapping portions and the second end in the stacking direction.

18. The liquid discharge head according to claim 1, further comprising a second common electrode formed on a third surface that is orthogonal to the stacking direction and is different in a position in the stacking direction from the first surface and the second surface, wherein the second common electrode includes a second extending portion extending in the second direction and a plurality of protrusions protruding from the second extending portion toward the first end and the second end, and wherein the protrusions partially overlap in the stacking direction with the first portions and the second portions.

19. The liquid discharge head according to claim 1, further comprising:

a first pressure chamber overlapping with the first portion in the stacking direction; and a second pressure chamber overlapping with the second portion in the stacking direction.

20. The liquid discharge head according to claim 19, further comprising:

a connecting channel connecting the first pressure chamber and the second pressure chamber, and a nozzle located in the connecting channel.

* * * * *